United States Patent [19]

Mayer

[11] 4,383,225

[45] May 10, 1983

[54] CABLES WITH HIGH IMMUNITY TO ELECTRO-MAGNETIC PULSES (EMP)

[76] Inventor: Ferdy Mayer, 18, rue Thiers, 38000-Grenoble, France

[21] Appl. No.: 166,403

[22] Filed: Jul. 7, 1980

[30] Foreign Application Priority Data

Jul. 6, 1979 [FR] France ..... 79 18065

[51] Int. Cl.[3] ..... H01P 3/00

[52] U.S. Cl. ..... 333/12; 174/36; 333/243

[58] Field of Search ..... 333/1, 12, 243, 184; 174/36, 106 R

[56] References Cited

U.S. PATENT DOCUMENTS

| | | | |
|---|---|---|---|
| 2,825,759 | 3/1958 | Clogston | 333/243 X |
| 2,831,921 | 4/1958 | Morgan, Jr. | 333/243 X |
| 2,879,318 | 3/1959 | Straube | 333/243 X |
| 3,219,951 | 11/1965 | Clark | 333/243 X |

*Primary Examiner*—Paul L. Gensler

*Attorney, Agent, or Firm*—Oblon, Fisher, Spivak, McClelland & Maier

[57] ABSTRACT

An electric cable comprising a plurality of separate screenings (3, 8), immunized against external parasites, particularly of high amplitude (common mode current, EMP etc.), wherein the screenings are separated by one or more insulating or slightly conducting magnetic layers (7), formed from magnetic compositions and applied by extrusion.

12 Claims, 5 Drawing Figures

CABLES WITH HIGH IMMUNITY TO ELECTRO-MAGNETIC PULSES (EMP)

Symmetrical electric cables (such as twisted pairs) constitute balanced lines and for this reason are not very sensitive to external parasitic electrical and magnetic fields. Asymmetrical electric cables (such as a coaxial cable) constitute unbalanced lines but the structure of the external conductor of which constitutes a screening, normally preventing any influence of external parasitic electrical and magnetic fields (exact case of a solid tube screening) and external surface currents created by these fields.

Now the imperfections associated with the practical construction of these cables, for example the fact that the screening of a coaxial is a braid, (for the flexibility) means that, in practice, these structures are penetrated sufficiently by these fields for their immunity to be inadequate in the case of transmitted signals of low amplitude and/or particularly intense parasitic fields.

In this case, for the construction of lines with high immunity, it is necessary to superimpose:

on pairs or other balanced structures: an electric screen, possibly followed (towards the outside) by a magnetic screen etc.

on a coaxial cable: a magnetic screen (over the screening braid), possibly followed (towards the outside) by an electric screen etc.

Such immunized structures are well known and described in the literature such as: "Use of magnetic materials for improvement of screening properties of different types of cables"; Lauri Holme and Joakko Annanpolo; IEEE Electromagnetic Compatability Symposium 1973 Record, pages 340–357, for example.

Thus it is conventional to use metallic magnetic layers in the form of braid or in the form of lapped strips of iron, steel, iron-nickel alloys with high magnetic permeability, amorphous magnetic alloy etc, participating both by their conductivity and their magnetic permeability in the improvement of the immunity.

FIG. 1, for example, shows the basic diagram of such a protected cable, considering a conventional coaxial line, covered with a magnetic screen and an additional conducting screen.

In this figure, 1 represents the conventional central conductor of the coaxial cable, 2 represents the conventional insulating dielectric (solid, ventilated, in rings etc.) and 3 represents the screening braid thus forming the transmission cable.

In this figure, 4 represents a flexible layer, that is to say a strip, sheet or braid of metal or conducting magnetic alloy (of the type of soft iron, steel or, for high performance, Mumetal, Permalloy, Metglas, lapped with overlapping turns) and 5 represents an external screening which is a good conductor (braid, lapping, band etc.). which may or may not be magnetic (copper being currently used in the case of a braid, and a strip of steel in the case of a cable with high mechanical strength).

Finally, 6 represents an external mechanical protection layer (plastics, elastomer etc.).

In such an embodiment, the magnetic layer 4 simultaneously plays the part of increasing the impedance of the self-inductance represented by the coaxial structure formed by the outside of the braid 3 and the interior of the screening 5, and the part of magnetic screening.

Now, it is obvious that the application of such a layer or of such layers, will, in the case of superimposed structures, greatly reduce the flexibility of the cable and, on the other hand make it fragile with regard to bending, vibration etc.

It is likewise obvious that such a layer or layers 4, will be sensitive not only to the lapping or to the formation of braid during the manufacture of the cable, but will also represent essentially variable performances during the life of the cable because the permeability varies with the shocks, deformations, vibrations etc. and this is the more so, the higher the initial permeability. Alloys of the Mumetal, Permalloy type, for example, with initial permeabilities of some 100,000 will finally diminish two values of a few hundred. It is another object of the present invention to describe a cable with high immunity in which the rigid magnetic layer or layers are replaced by one or more flexible magnetic layers, of the composite type, the effective permeability of which is of the order of 5 to 30, but the value of which is absolutely stable, depending on permanent and brief mechanical stresses.

It is likewise obvious that such a layer or layers 4, because of their metallic conductivity and/or their magnetic permeability, will represent a very slight skin effect thickness, particularly at high frequencies—and for the practical thicknesses which are the least which can be used—will give rise to a poor utilization because the electromagnetic fields cannot penetrate the metal. It is another object of the present invention to describe a cable with high immunity, in which the metallic magnetic layer or layers are replaced by one or more insulating magnetic layers or layers of sufficient resistivity to reduce this skin effect, particularly in the upper range of the frequencies in question.

It is likewise obvious that such a layer or layers 4, more particularly in the case of high permeability, are sensitive to high magnetic parasitic fields, saturating the magnetic materials. More particularly, in the case of lightning discharges close to the cable or of electromagnetic pulses (EMP) due to a nuclear explosion, the effectiveness of the layer may be cancelled, an effect which is of fundamental importance for cables intended for military telecommunications. It is another object of the invention to describe a cable with high immunity in which the magnetic layer or layers are not very saturable because of their composite structure, that is to say comprising magnetic grains with high permeability, in a non-magnetic plastics binder: the structure with multiple air gaps which results not being very saturable.

It is likewise obvious, that such a layer or layers 4, along the length of the cable in question, for a given frequency, may give rise to line resonance phenomena, with maxima and minima of current and voltage, which, because of the imperfection of the cable, are reproduced on the central conductor. It is another object of the invention, particularly at high frequencies, to introduce an absorption into the composite magnetic medium, in order to reduce or eliminate these resonance effects.

Finally, it is obvious that such a layer or layers 4, are expensive to produce because of the price of the magnetic material (with high permeability, thin strips etc.) and their use (special lapping with few stresses). The last object of the invention is to describe a cable with high immunity, in which the magnetic layer or layers are produced by a conventional extrusion process, which is rapid and inexpensive, from cheap magnetic ferrite materials and more particularly their waste.

The composite magnetic material may be of the type of those described in the U.S. Pat. No. 3,191,132 and U.S. Pat. No. 3,309,633; more particularly improved materials and their use are described in the U.S. patent application Ser. No. 202,654 of Oct. 31, 1980, which is a continuation of U.S. patent application Ser. No. 019,799 of Mar. 12, 1979, abandoned, which is a continuation of U.S patent application Ser. No. 855,593 of Nov. 25, 1977, abandoned.

The invention will be described in more detail in the description which follows with the aid of several figures, in order to show its characteristics and the results obtained; in the FIGS. 2, 3, 4 and 5 cited by way of example, the conventional asymmetrical coaxial structure will be considered; it is obvious that the same considerations apply to all other symmetrical or asymmetrical transmission structures and the two together more particularly in the case of multi-conductor cables.

Figure 1:
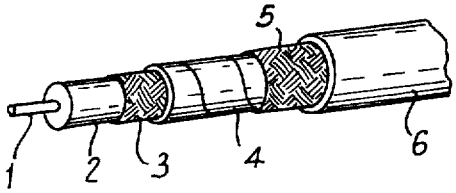
Fig:1 PRIOR ART
FIG. 1 illustrates a conventional protected cable.
Figure 2:
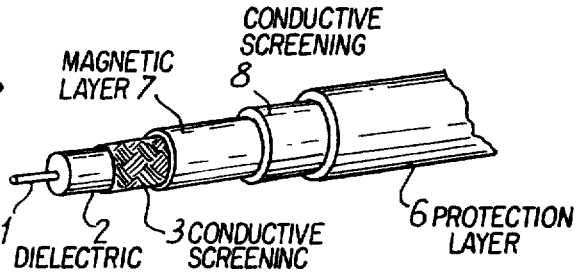
FIG. 2 illustrates diagrammatically a cable with high immunity according to the invention, with double screening and an intermediate flexible magnetic layer.

One of the preferred embodiments of the invention is described in FIG. 2.

In this figure, 1 represents the central conductor of the coaxial cable, 2 the usual dielectric, 3 a conducting layer of high quality as regards immunity to external parasitic fields. This layer may be of the type in a sheet or in a braid with a low resistance to direct current: this value actually defines the transfer impedance for direct current and at very low frequencies. It will be optimized as regards leakages, according to the rules of the art as described, for example, by E. HOMANN NTZ No. Mar. 3, 1968 pages 155–161 and E. F. VANCE, IEEE Transactions on EMC, May 1975 pages 71–77, in such a manner as to represent a pronounced minimum of the transfer impedance Zt in the intermediate frequencies.

In this figure, 7 represents a magnetic layer, in accordance with the aforesaid patents: this layer of magnetic material, in the form of a mixture of ferrite powder, of iron carbonyl or other magnetic materials mixed with a plastics or elastomer material, is extruded round the cable 1, 2 and 3 by conventional cable-making techniques: its thickness will be from some tenths of a mm to a few mm, according to the diameter of the coaxial cable 1, 2 and 3. Then a conducting layer 8, consisting of a second braid (optimized according to the rules indicated), coat of conducting paint, band of metallized mylar and/or an extruded conducting composite material forms the second screening. This type of paint or composite material is known to those skilled in the art and is manufactured by the American companies:

Scientific Advances;
Emerson and Cuming;
Chomerics;
Custom Materials;
Technical Wire Products etc.

The minimum thickness of this layer will depend on its conducting properties: the minimum frequency at which the immunity effect will be marked corresponding to some skin thicknesses of the material of the layer.

Figure 3:
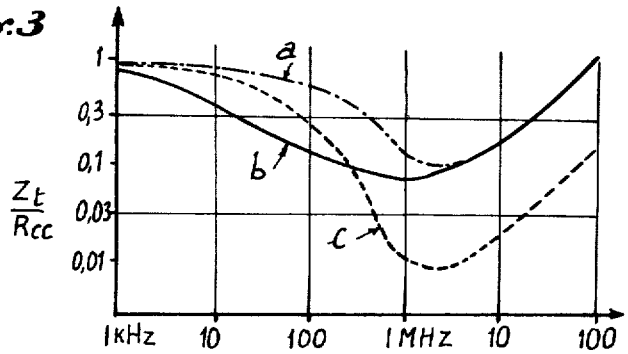
FIG. 3 illustrates the transfer impedance depending on the frequency for different types of cable.

FIG. 3 illustrates the transfer impedance depending on the frequency for different cables, expressed as a relative value in relation to the direct-current resistance of the assembly of screenings connected in parallel.

In this figure, the curve (a) represents the transfer impedance of the structure of FIG. 2, with a non-magnetic insulator in place of the layer 7. The curve (b) shows the transfer impedance of the structure described: an improvement greater than 10 db is seen in the range of 10 KHZ to nearly 1 MHZ. This improvement is such that up to about 200 KHZ, the structure according to FIG. 2 is even better than a cable with three braids, with non-magnetic insulators between each screening.

It can easily be shown that this improvement is proportional to the sum of the impedance of the external surface of the screening 3, of the impedance of the internal layer of the screening 8 and of the impedance of the loop formed by the space of the magnetic medium 7: this latter term with the increases corresponding to the magnetic permeability of this medium introduces the improvement in immunity.

The structure according to FIG. 2 with a copper braid has been subjected to parasitic current pulses of high amplitude: up to 200 A the transfer impedance follows the curve (b)—that is to say the cable retains its immunity—which would not be the case with a magnetic layer of the mumetal or permalloy type.

Figure 4:
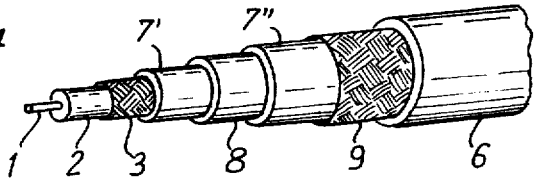
FIG. 4 illustrates diagrammatically a coaxial cable with very high immunity according to the invention, with triple screening and two interposed magnetic layers.

A second preferred embodiment according to the corresponding invention has a cable with very high immunity: it is described in FIG. 4.

In this figure, 1, 2 and 3 represent the actual coaxial structure, as before. Two magnetic layers 7' and 7'', in accordance with the aforesaid patents, are separated by a thin conducting layer 8, in the form of a braid, sheet, paint or conducting composite material, made in accordance with the above rules. The external screening 9, in the form of braid, sheet, paint, metallized band, and/or conducting composite material, are covered by the protective insulator 6.

A particularly interesting embodiment corresponds to the simultaneous extrusion of the layers 7', 8 and 7'' because of its reduced prime cost, of its great flexiblity and the mechanical strength obtained: with a transfer impedance equal to the best structures with lapping of magnetic strips, which are expensive and fragile.

In these examples, it has been assumed that the conductor to be protected was a coaxial cable: according to the invention, it is obvious that the part to be protected may consist of a pair, three, quad etc. or finally of an assembly of a plurality of symmetrical or asymmetrical strutures (which may or may not be screened and may or may not be immunized), arranged in the same envelope. Also, in these examples, immunity to high frequency parasites has been considered above all: at low frequencies the immunity approaches more and more the continuous resistance and the inductive terms, due to the permeability of the magnetic medium or mediums, obviously approach zero, with the frequency.

Figure 5:
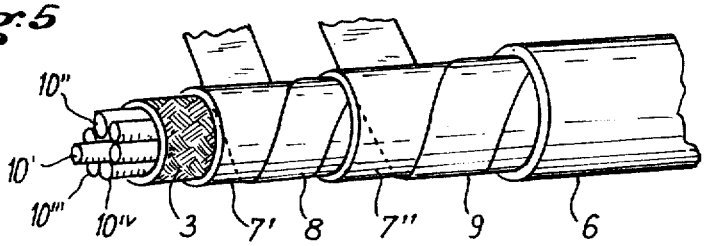
FIG. 5 illustrates diagrammatically a screened cable with multiple conductors, with very great immunity according to the invention, more particularly for low frequencies.

In the example of FIG. 5 which follows, an example of an embodiment of a screening with high immunity according to the invention will be given for an assembly of cables, more particularly at the mains frequencies. (In fact, common mode currents at 50, 60 or 400 HZ of high amplitude, represent a major problem for teletransmission and telesignalling cables on board aircraft, ships, along railways with electric traction etc.)

In this FIG. 5, the internal cables to be protected are represented by 10', 10'', 10''', 10$^{IV}$ etc. They are surrounded by a first screening 3, which is a good flexible conductor (copper braid, continuous lead sheath etc.). Then comes an insulating lapping of an extruded magnetic material 7' covered in turn by a wound strip of iron or steel 8.

Then comes a second layer of extruded material 7'' covered in turn by a wound strip of iron or steel 9.

In such a complex structure, composed of a plurality of conducting layers and magnetic non-conducting layers, the immunity effect at low frequencies is important and the antisaturation effect is optimized.

As a rule, the materials with high permeability, that is to say which are saturated most easily, are placed towards the inside and the materials which are not very saturable (or are made so as not to be very saturable, by the effective air gaps due to lapping with an air gap, with a suitable pitch) are placed towards the outside. Likewise, as a rule, the material which is the best conductor should be placed towards the inside of the structure, which is also equivalent to a long pitch, to the extent that the longitudinal resistance of a lapping and of a braid varies with the COS function of the angle of the helix in relation to the axis. Obviously the various conducting screenings are suitably connected at the regions of the terminal connections.

It is obvious that the individual cables of such a complex structure may be all of partially protected in turn, by the methods according to the invention, more particularly simple screened cables may comprise an external flexible magnetic layer and constitute, with the total screening, a protection as described.

Another object of the invention is to use the losses of the magnetic mixtures described, at high frequencies, possibly increased by an additional controlled conductivity, in order to eliminate the effects of resonance of the space or spaces between the screenings.

Another object of the invention is to render maximum the impedances of surface described, in addition to the maximization of the impedance between screenings as described. For this purpose, more particularly, arrangements of the surface of the metallic conductors may serve, by the introduction of the normal skin effect (case of the composite cable of FIG. 5 with the magnetic bands) or the artificial skin effect as described in the U.S. Pat. No. 3,573,676.

Another object of the invention is to add to the extrusion of the structure of the complete cable, a final external absorbing magnetic layer increasing the impedance of the external surface, for additional protection against common mode currents and against cross talk.

It is obvious that the principles described in the examples of asymmetrical coaxial structures, apply in the same manner to any symmetrical coaxial structure, structures in pairs, triplets, quads etc, which may be symmetrical and asymmetrical, in the same screening envelope, as well as assemblies of such structures in the same screening envelope. It is likewise obvious that the principles described apply to a higher number of successive layers, with the object of obtaining a very great immunity to parasitic fields.

I claim:

1. A flexible electric cable for transmission of predetermined signals and having high immunity to parasitic fields, comprising:

at least one signal conductor; and shielding means, not contributing to the transfer of said predetermined signals through said cable, for decreasing the transfer impedance of said cable, comprising, a first flexible conductive screening concentrically surrounding said at least one conductor, at least one magnetic medium formed of a flexible lossy essentially insulating magnetic composite material concentrically surrounding said first flexible conductive screening, and at least a second flexible conductive screening concentrically surrounding said magnetic medium.

2. An electric cable as claimed in claim 1, further comprising:

said first conducting screening being a good conductor and covered with a layer of said flexible magnetic composite material;

said layer of said flexible magnetic composite material being flexible in its mass and being substantially nonconductive; and said layer of said flexible magnetic composite material covered with a layer of said second conductive screening which is a good conductor and which is metallic.

3. An electric cable as claimed in claim 1, further comprising:

another layer of lossy magnetic composite material which is flexible in its mass and which is substantially nonconductive covering the second metallic screening layer; and a third external conductive screening layer covering said further layer of magnetic composite material, said third external screening layer being a good conductor.

4. An electric cable according to claim 3, wherein the conductive screening layers are made from materials selected from the group consisting of braids of wire, braids of strips, wire tapes, strip tapes, and strips of metallized composites, using continuous metallic conductors.

5. An electric cable according to claim 1, wherein said second conductive screening comprises:

a composite material formed of metallic conducting particles imbedded in a flexible material.

6. An electric cable as claimed in claim 4, wherein said third conductive screening comprises:

a composite material formed of metallic conducting particles imbedded in a flexible material.

7. A cable as claimed in claims 1, 2, 3, 4, 5, or 6, wherein the at least one magnetic medium comprises:

a mixture, in a flexible matrix, of a powder selected from a ferrite powder and a powder of metallic magnetic materials, having a predetermined grain size and concentration and exhibiting the effects of magnetic permeability, electro-magnetic absorption loss at high frequency, and a high resistance, such that the magnetic medium has a skin thickness greater than the thickness of the magnetic medium and absorbs the effects of high frequency resonance.

8. A cable as claimed in claim 1, further comprising:

an external composite magnetic layer applied concentrically around said second flexible conductive screening to increase the external surface impedance and to introduce losses therein by increasing the surface impedance and resonance, against common mode parasites and cross talk.

9. A cable as claimed in claim 1, further comprising:

said conductive screenings having the surface impedance thereof increased at the interfaces of said said screenings with the flexible lossy magnetic medium by the application of conducting magnetic alloys to the screening surfaces, whereby the surface impedance of said conductive screening surfaces is increased by the skin effect.

10. A cable as claimed in claim 1, further comprising:

said conductive screenings having the surface impedance at the interface between said screenings and said flexible lossy magnetic medium increased using an artificial skin effect achieved by forming the conductive screenings of metallic layers having variable permeability.

11. A cable as claimed in claim 1 or 10, further comprising:

said conductive screenings having the surface impedance at the interface between said screenings and said flexible magnetic medium increased using an artificial skin effect achieved by forming the conductive screenings of metallic layers having variable resistivity.

12. A cable as claimed in claims 9, 10, or 11 comprising:

said conductive screenings formed of helically lapped strips, braids or magnetic sheets of conductive material and including air gaps determined by the pitch of the helices of the lappings to avoid local magnetic saturation.

* * * * *